United States Patent [19]

Iizuka

[11] Patent Number: 4,643,338

[45] Date of Patent: Feb. 17, 1987

[54] MANUAL LIQUID DISPENSER

[75] Inventor: Shigeo Iizuka, Tokyo, Japan

[73] Assignee: Yoshino Kogyosho Co., Ltd., Tokyo, Japan

[21] Appl. No.: 793,322

[22] Filed: Oct. 29, 1985

Related U.S. Application Data

[62] Division of Ser. No. 612,899, May 22, 1984, Pat. No. 4,591,076.

[51] Int. Cl.[4] ..... B05B 9/00

[52] U.S. Cl. ..... 222/321; 222/385; 239/333

[58] Field of Search ..... 222/309, 321, 383, 385; 239/333

[56] References Cited

U.S. PATENT DOCUMENTS

| | | | |
|---|---|---|---|
| 4,051,983 | 10/1977 | Anderson . | |
| 4,228,931 | 10/1980 | Ruscitti et al. | 222/321 |
| 4,317,531 | 3/1982 | Saito et al. . | |
| 4,361,255 | 11/1982 | Saito et al. | 222/321 |
| 4,365,729 | 12/1982 | Saito et al. . | |
| 4,503,996 | 3/1985 | Sorm et al. . | |

*Primary Examiner*—H. Grant Skaggs
*Attorney, Agent, or Firm*—Parkhurst & Oliff

[57] ABSTRACT

A manual liquid dispenser which has a mounting member (1) engaged fixedly with a guide cylinder (11) from the inner surface of the upper end thereof, depending from a neck portion (4) into a container (3) and engaging cylinder (8) stood upwardly therefrom, a spraying head (24) capable of being depressed and formed with a valve seat (19) of a discharge valve (18) and a valve port (20) at the center thereof on the back surface thereof, a rod member (24) slidably contacted with the inner surface of the guide cylinder (11), and a returning coiled spring (27) for always upwardly lifting the spraying head (14) through the rod member (24) and seating the valve body (25) on a valve seat (19) to close the discharge valve (18), and a communication tubular member (28). Thus, when the spraying head (14) is depressed in case of spraying the liquid in the container, a third pressure chamber C is formed between the outer surface of the lower large-diameter part of the rod member (24) and the inner surface of the lower increased-diameter part of the small-diameter cylinder (6).

2 Claims, 4 Drawing Figures

MANUAL LIQUID DISPENSER

This is a division of application Ser. No. 612,899, filed May 22, 1984, and now U.S. Pat. No. 4,591,076.

BACKGROUND OF THE INVENTION

This invention relates to an improved manual liquid dispenser.

A conventional manual liquid dispenser of this type has a structure of normal vertical reciprocating pump type. Liquid contained in the dispenser is pressurized and sprayed by pressing a spraying head downwardly in a forth stroke, and the liquid is then sucked into the head by the head turning upwardly by means of a returning coiled spring in a backward stroke.

SUMMARY OF THE INVENTION

It is an object of the present invention to provide a manual liquid dispenser capable of operating a high efficiency with a structure for spraying liquid even upon sucking of liquid into a spraying head in a backward stroke when the head is returning upwardly by means of a returning coiled spring.

The foregoing objects and other objects as well as the characteristic features of the invention will become more fully apparent and more readily understandable by the following description and the appended claims when read in conjunction with the accompanying drawings.

DESCRIPTION OF THE PREFERRED EMBODIMENTS

Embodiments of a manual liquid dispenser constructed according to the present invention will be described with reference to the accompanying drawings.

Figure 1:
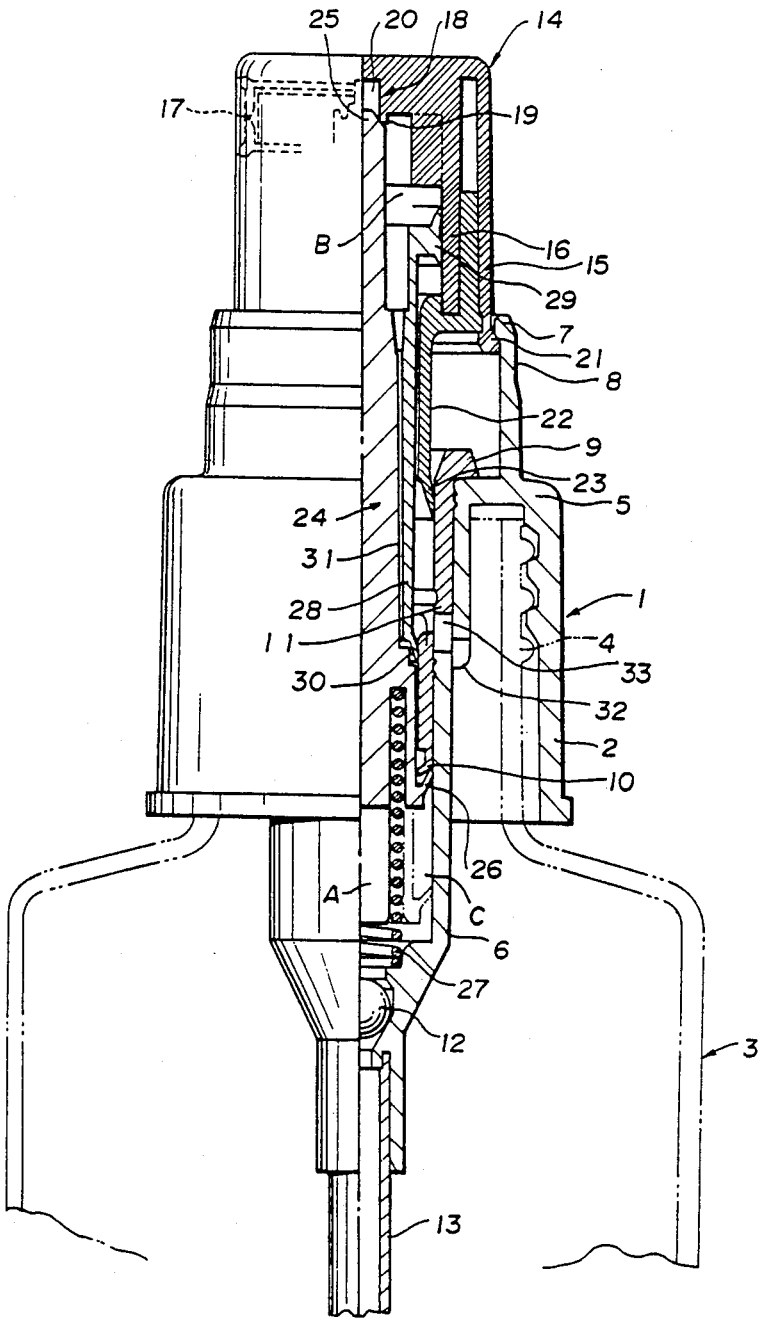
FIG. 1 is a longitudinal elevational fragmentary view showing an embodiment of a manual liquid dispenser in section at the half part thereof according to the present invention.

In FIG. 1, reference numeral 1 designates a mounting member which is mounted by threading at the inner peripheral threaded surface of a peripheral wall 2 thereof on the outer peripheral threaded surface of a neck portion 4 of a container 3, member 1 is reduced in diameter thereof in a stepped shape at the middle thereof from the inner end of an inward flange 5 of an upper end of the peripheral wall 2. Member 1 is further formed integrally with small-diameter cylinder 6 extending from the flange 5 into the container 3. Member 1 is further formed integrally with an engaging projection 7 extending from the upper inner periphery of the upper surface of an engaging cylinder 8 extending from the intermediate part of the inward flange 5. In this case, it is noted that the cylinder 6 may be isolated, extending from the neck portion 4 of the container 3 and retained fixedly by the peripheral wall 2 and the engaging cylinder 8 of the mounting member 1.

Further, an engaging projection 9 is projected outwardly from the upper end of the small-diameter cylinder 6. Cylinder 6 further includes a stepped part which is formed by constricting the inner diameter of the upper half part from the inner diameter of the lower half part of the cylinder 6 by engaging fixedly a guide cylinder 11 of a stepped shape corresponding to a cylindrical piston 10.

A spherical suction valve 12 is internally mounted in the opened bottom of the cylinder 6, and a sucking tube 13 which is depended from the bottom of the cylinder 6 toward the bottom of the container 3 is secured fixedly to the lower end of the bottom of the cylinder 6. It is noted that the cylinder 6 and the guide cylinder 11 may be formed integrally.

A spraying head 14 is slidably provided to be capable of being depressed down in contact between the engaging cylinder 15 of the peripheral edge thereof with the inner periphery of the engaging cylinder 8. This head 14 has a large-diameter cylinder 16 which is larger in bore than the bore of the small-diameter cylinder 6 and which is extended from the inside of an engaging cylinder 15. A nozzle port 17 is perforated at one side, a valve seat 19 of a discharge valve 18 and a discharge valve port 20 communicating with the nozzle port 17 are formed at the center on the back surface of the head 14. An engaging projecting strip 21 located on the outer periphery of the lower end of the engaging cylinder 15 is formed to prevent the head 14 from being removed from the mounting member 1 by engaging the strip 21 with the engaging projection 7. Reference numeral 22 designates an outer cylinder which is interposed at the upper half part thereof between the engaging cylinder 15 and a large-diameter cylinder 16, which includes a cylindrical piston 23 of reduced diameter at the lower end of the lower half part of cylinder 22. Piston 23 is depended downwardly in sliding contact with the inner surface of the upper part of the guide cylinder 11.

Then, a rod member 24 extends upwardly in slidable contact with the inner periphery of the guide cylinder 11. This rod member 24 is cut in a tapered shape at the upper outer surface thereof to form a valve body 25 of discharge valve 18, and has an oblique upper outward cylindrical flexible valve 26 which is slidably contacted with the inner periphery of the lower half part of the small-diameter cylinder 6 under the cylindrical piston 10 at the outer periphery of the lower end thereof. Further, this rod member 24 also has a peripheral groove which is relatively deep and is formed on the loewr surface thereof to be always upwardly pressed by a returning coiled spring 27 arranged between the peripheral groove and the bottom of the cylinder 6, thereby closing the discharge valve 18 by seating the valve body 25 of the upper end thereof on the valve seat 19. A tubular member 28 is engaged on the outer surface of the middle-diameter part at the middle of the rod member 24. A cylindrical piston (C) 29 which is slidably contacted with the inner surface of the cylinder 16, is disposed on the upper end of the tubular member 28, and a cylindrical piston 30 which is slidably contacted with the inner surface of the guide cylinder 11, is disposed on the lower end thereof. A slot 31 is longitudinally formed as a liquid passage for communicating with the nozzle port 17 through the discharge valve 18 along the outer surface of the the lower large-diameter part of the intermediate middle-diameter part of the rod member 24. Reference numerals 32 and 33 designate through holes.

The operation of the liquid dispenser thus constructed according to the present invention is as follows: Assume that the liquid sucked is filled in a first pressure chamber A in the cylinder 6 for the convenience of description. When the spraying head 14 is manually depressed downwardly against the tension of the returning coiled spring 27, the outer cylinder 22, the tubular member 28 and the rod member 24 are simultaneously moved downwardly, thereby narrowing the volume of the first pressure chamber A. Thus, the liquid in the first pressure chamber A is pressurized. When the pressure of the liquid reaches a predetermined valve, the flexible value 26 is deflected to open the valve. Then, the pressurized liquid in the first pressure chamber A is fed through the flexible valve 26, and slot 31 into a second pressure chamber B of the large-diameter cylinder 16. Thus, the first and second pressure chambers A and B are connected. At this time, since the pressure of the liquid in the second pressure chamber B is larger than the lifting force of the liquid in the first pressure chamber A applied to the rod member 24, rod member 24 moves downwardly so as to open the discharge valve 18. Thus, the pressurized liquid in the second pressure chamber B is outwardly sprayed or atomized from the nozzle port 17 through the discharge valve 18. At this time, the rod member 24 is located at the lowermost position as designated by broken lines.

When spraying of the liquid is thus finished, the manual depression of the spraying head 14 is stopped. Then, the rod member 24 and accordingly the spraying head 14 are returned upwardly by the returning coiled spring 27, thereby sucking the liquid in the container 3 through the sucking tube 13 and the sucking valve 12 into the first pressure chamber A. Simultaneously, the remaining liquid in a third pressure chamber C formed between the lower outer surface of the rod member 24 and the inner surface of the lower half part of the small-diameter cylinder 6 is pressurized by reducing, the volume thereof due to the returning rise of the rod member 24. Accordingly, the pressurized liquid in the third pressure chamber C is sprayed through the slot 31 from the nozzle port 17 before the discharge valve 18 is closed. More specifically, when the spraying head 14 is manually moved downwardly in the forth stroke and is returned upwardly by the returning coiled spring, the liquid is sprayed in both strokes.

Figure 2:
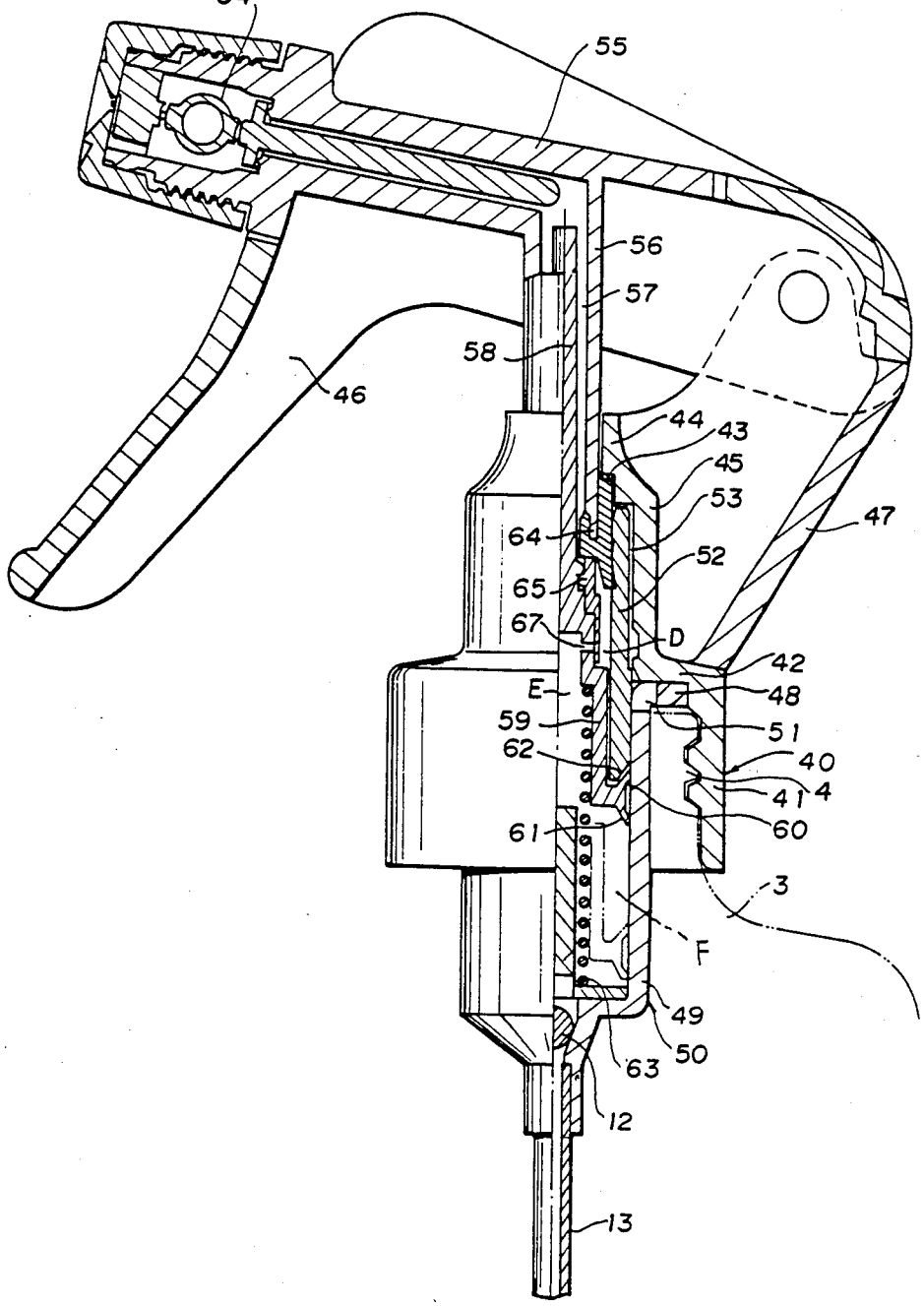
FIG. 2 is a schematic view showing another embodiment of the manual liquid dispenser of trigger operated type according to the present invention.

FIG. 2 shows another embodiment of a liquid dispenser of trigger type according to the present invention.

In FIG. 2, reference numeral 40 designates a mounting member which is mounted by threading at the threaded inner peripheral wall 41 thereof on the outer periphery of the neck portion 4 of a container 3, and an engaging cylinder 45 which has an engaging projecting strip 44 formed on engaging cylinder 45 which extends from the inner end of the inward flange 42 of the peripheral wall 41. A mounting member 47 to which a rotary end of a trigger 46 is pivotally secured toward the outer upward direction, is integrally provided with the engaging cylinder 45.

A flange 48 which is intimately contacted with the lower surface of the flange 42 at the upper end thereof is provided at the inside of the peripheral wall 41, and is connected to a cylinder 50 which has a peripheral wall 49 extending from the inner end of the flange 48 into the container is provided at the inside of the wall 41. A through hole 51 which communicates with the container is formed at the bent part of the peripheral wall 49 and the flange 48.

A guide cylinder 52 which has a notch 62 at the lower outside thereof is engaged fixedly with the inner peripheral surface of the upper half part of the peripheral wall 49 of the cylinder 50, and the upper half part of the guide cylinder 52 extends downwardly of the engaging projecting strip 44 along the inner surface of the engaging cylinder 45. A passage 53 which communicates with the through hole 51 is formed by forming a slit on the guide cylinder 52 between the guide cylinder 52 and the engaging cylinder 45.

A Large-diameter cylinder is formed at the lower half part thereof to be larger in diameter than the upper half part thereof because of the guide cylinder 52. In other words, the large-diameter cylinder is formed by cylinder 50 with guide cylinder 52 inserted therein. A spherical suction valve 12 is internally provided in the opened bottom of the cylinder 50, and a sucking tube 13 which is extended from the lower end to the bottom of the container is fixedly attached to the lower end of the bottom of the cylinder 50.

A small-diameter cylinder 56, which is integrally formed with the body 55 having a spraying section 54, is slidably depended to be engaged within the mounting member 40 through an opening formed at the end thereof. This cylinder 56 may be depressed downwardly by a structure of trigger type known per se. Further, a rod member 58 which has a liquid passage 57 is internally mounted in the small-diameter cylinder 56. A piston 59, which is expanded in diameter in a skirt shape from the upper part thereof is formed at the lower part of the rod member 58. Piston 59 is disposed at the inner peripheral surface of the large-diameter cylinder 49.

An oblique upper outward flexible valve 60, which is slidably contacted with the lower inner peripheral surface of the large-diameter cylinder 49, and an oblique lower outward flexible valve 61, are formed on the outer periphery of the lower end of the piston 59. The flexible valve 60 is engaged within the notch 62 of the lower end of the guide cylinder 52 when the piston 59 is disposed at the normal position. A returning coiled spring 63 is arranged between the stepped part formed on the inner part of the piston 59 and the bottom of the cylinder 49, thereby always urging upwardly the piston 59 and hence the rod member 58 by the spring 63.

With the lower end of the small-diameter cylinder 56 is engaged an outer cylindrical member 64 which is inserted between the outer peripheral surface of the cylinder 56 and the inner surface of the guide cylinder 52, is engaged at the upper end thereof with the engaging part 43 of the projecting strip 44 at the upper end of the mounting member 40, and is slidably contacted at the lower end thereof with the inner peripheral surface of the guide cylinder 52. Further, a cylindrical member 65 which is engaged externally with the rod member 58, interfaces to member 64 is provided under the small-diameter cylinder 56, and rod member 58 is depressed downwardly by the cylindrical member 65 by the operation of the cylinder 56. This cylindrical member 65 is formed of a material which has flexibility to outwardly expand at the lower end by a predetermined pressure.

Figure 3:
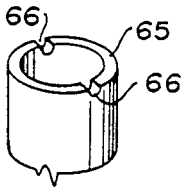
FIG. 3 is a partial perspective view showing an essential component of the manual liquid dispenser.

A pressure chamber (D) is formed between the cylindrical member 65 and the guide cylinder 52. Further, as shown in FIG. 3, a plurality of notches 66 are formed on the upper end surface of the cylindrical member 65, thereby communicating between the pressure chamber (D) and the passage 57 in the cylinder 56. A communication hole 67 which is perforated radially is formed at the upper peripheral wall of the piston 59 of the rod member 58 corresponding to the lower part of the cylindrical member 65, thereby communicating between the pressure chamber D and the pressure chamber E of the piston 59 through the hole 67 when the lower part of the cylindrical member 65 expands externally.

According to the embodiment of the trigger type of the liquid dispenser described above in accordance with the invention, the the inner diameter of the lower half of the cylinder 49 is larger than the diameter of the inner diameter of the upper half part thereof, and when the cylinder 56 is depressed downwardly in case of spraying the liquid, a third pressure chamber F is formed between the outer surface of the piston 59, which is moved downwardly to the lower part of the cylinder 49 upon depressing of the cylinder 56, and the lower inner surface of the cylinder 49. Therefore, the volume of the pressure chamber F is reduced when the piston is returned upwardly, thereby pressurizing and spraying the remaining liquid in the pressure chamber F, and the liquid is thus sprayed even when the cylinder 56 is returned upwardly in addition to the case that the cylinder 56 is depressed downwardly. The sealing effect of the liquid can be further increased by providing the flexible valve 61 at the lower end of the piston 59.

Figure 4:
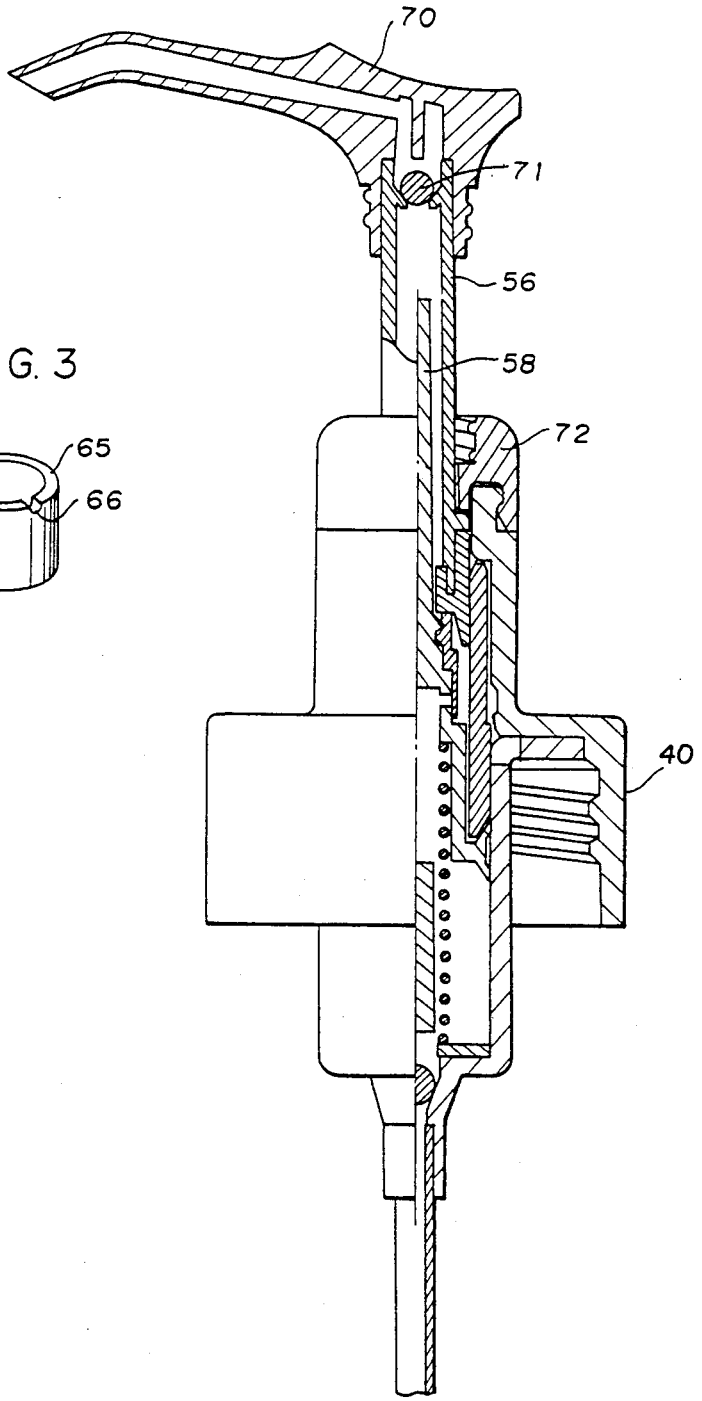
FIG. 4 is a schematic view showing still another embodiment of the manual liquid dispenser for spraying viscous liquid according to the present invention.

FIG. 4 shows still another embodiment of the liquid dispenser for viscous liquid according to the present invention. In the structure of the dispenser of this embodiment, a nozzle 70 is formed at the end of a cylinder 56, and a spherical valve member 71 is provided in the end of the cylinder 56. Further, the cylinder 56 is engaged with a supporting member 72 provided at the end of a mounting member 40, so that the cylinder is not moved upwardly from a predetermined position, i.e., not moved removed from the mounting member 40. The other internal structure of this embodiment is similar to the structure of the dispenser of trigger type described in the second embodiment, and the description is omitted.

According to the present invention as described above, the bore of the lower half part of the smalldiameter cylinder 6 is larger than the bore of the upper half part of the cylinder 6, and when the spraying head 14 is depressed in order to spray the liquid of the container, a third pressure chamber C is formed between the lower outer surface of the rod member and the inner surface of the lower half part of the small-diameter cylinder 6. Accordingly, when the spraying head 14 and hence the rod member 24 is returned upwardly by the returning coiled spring, the volume of the pressure chamber C is reduced to pressurize the remaining liquid in the pressure chamber C, and the liquid can be sprayed even when the head is returned upwardly in addition to the case that the head 14 is depressed downwardly, thereby providing a liquid dispenser of highly efficient spraying operation.

What is claimed is:

1. A manual liquid dispenser comprising:

a mounting member mounted on an outer peripheral wall of a neck portion of a container and having an engaging cylinder extending upwardly therefrom:

a large-diameter cylinder extending into the container, said large-diameter cylinder having a diameter in a lower half part thereof larger than a diameter in an upper half part thereof;

a suction valve internally mounted in an opened bottom of said large-diameter cylinder;

a sucking tube communicating with said suction valve and extending to the bottom of the container;

a small-diameter cylinder inserted into and extending from the interior of said mounting member and integrally formed with a body having a liquid spraying section including a dispensing outlet;

said small-diameter cylinder being slidably moved by the operation of the body;

a rod member internally mounted in said small-diameter cylinder;

said rod member having formed at the lower part thereof a piston expanded in diameter in a skirt shape;

a flexible seal formed at the lower end of said piston and slidably contacted with the lower inner peripheral surface of said large-diameter cylinder;

a spring arranged between the interior of said piston and the bottom of said large diameter cylinder for always urging said rod member upward;

an outer cylinder formed at a lower end of said small-diameter cylinder and slidably contacted at a lower end thereof with said upper half part of said large-diameter cylinder to form a first pressure chamber beneath said outer cylinder and inside said upper half part of said large diameter cylinder;

a cylindrical member engaged with the outer periphery of said rod member, contacted at the upper end thereof with said outer cylinder and disposed at the lower end thereof at a radial communication hole formed in said rod member;

a notch, communicating the first pressure chamber and the interior of said small-diameter cylinder, formed on the upper end surface of said cylindrical member;

a flexible member formed at the lower end of said cylindrical member adjacent said radial communication hole, to externally expand when a second pressure chamber within said piston reaches a predetermined pressure;

wherein a third pressure chamber is formed between said piston and the peripheral wall of said large-diameter cylinder when said piston is depressed downwardly;

wherein, a downward force on said small-diameter cylinder forces liquid from said second pressure chamber through said radial communication hole, into said first and third pressure chambers, through said notch and into said liquid spraying section; and wherein release of said downward force allows said spring to return said piston upward thereby recharging said second pressure chamber through said suction valve, and forcing liquid from said third pressure chamber into said first pressure chamber, through said notch and into said liquid spraying section.

2. The manual liquid dispenser according to claim 1, wherein said flexible seal comprises a first oblique upper outward flexible seal and a second oblique downward flexible seal.

* * * * *